US006720723B2

(12) United States Patent
Murai et al.

(10) Patent No.: US 6,720,723 B2
(45) Date of Patent: Apr. 13, 2004

(54) CATHODE RAY TUBE FOR ACHIEVING SMALL ELECTRON BEAM LANDING DEVIATION

(75) Inventors: Ryuichi Murai, Toyonaka (JP); Shinichiro Hatta, Nara (JP); Hiroshi Iwamoto, Toyonaka (JP); Tetsuro Ozawa, Ibaraki (JP); Shigeo Nakatera, Hirakata (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 230 days.

(21) Appl. No.: 09/808,818

(22) Filed: Mar. 15, 2001

(65) Prior Publication Data

US 2001/0026119 A1 Oct. 4, 2001

(30) Foreign Application Priority Data

Mar. 16, 2000 (JP) ..... 2000-073810

(51) Int. Cl.[7] ..... H01J 29/74
(52) U.S. Cl. ..... 313/433; 313/313
(58) Field of Search ..... 313/402, 407, 313/479, 313, 433, 426, 432, 437, 439, 443, 477 R, 440; 174/35 MS; 315/85

(56) References Cited

U.S. PATENT DOCUMENTS 5,363,010 A * 11/1994 Van Mensvoort ..... 313/402
5,434,470 A * 7/1995 De Wit et al. ..... 313/402
5,773,924 A * 6/1998 Nakamura ..... 313/402
6,020,678 A * 2/2000 Maehara ..... 313/402
6,388,368 B2 * 5/2002 Matsudate et al. ..... 313/402

OTHER PUBLICATIONS

LP–2: Late–News Poster: "Home Base–Shaped Inner Magnetic Schield," by R. Murai et al., SID 00 Digest, ©2000 SID, pp. 582–585.

* cited by examiner

*Primary Examiner*—Sandra O'Shea
*Assistant Examiner*—Peter Macchiarolo

(57) ABSTRACT

A cathode ray tube including an internal magnetic shield in the shape of a hollow rectangular frustum including two long sides opposite to each other and two short sides opposite to each other, having an opening at its top and bottom attached to a mask and a frame. Each long side has a long side extension at a horizontal center located at the top of the internal magnetic shield where an electron beam enters the internal magnetic shield. The long side extensions enable the magnetic shield to reduce the deviation of an electron beam within the magnetic shield caused by an external magnetic field such as that caused by terrestrial magnetism.

33 Claims, 14 Drawing Sheets

CATHODE RAY TUBE FOR ACHIEVING SMALL ELECTRON BEAM LANDING DEVIATION

BACKGROUND OF THE INVENTION (1) Field of the Invention

The present invention relates to a cathode ray tube. More particularly, the present invention relates to an internal magnetic shield within the improved cathode ray tube having a shape adapted for correcting the trajectory of electron beams that have been deviated by an external magnetic forces, most typified by terrestrial magnetism.

(2) Description of Related Art

FIG. 11 shows a conventional cathode ray tube (hereinafter referred to as CRT) used as a TV display or a monitor for a personal computer. An electron beam 111 emitted from an electron gun is deflected vertically or horizontally by a deflection coil 112 to scan the whole screen to reproduce an image. In this process, what is called landing deviation may happen. That is to say, the electron beam 111 may deviate from an intended trajectory and may not reach an aimed position when it receives an external magnetic field such as terrestrial magnetism from a direction perpendicular to the direction of the trajectory of the beam. In FIG. 11, the center line indicates an originally intended trajectory, and the center line the deviated trajectory (this example is exaggerated a little). To prevent the landing deviation, an internal magnetic shield 115 is disposed to surround a path of the electron beam inside the CRT (in this case, inside a funnel). It should be noted here that in the CRT, typically a raster scan method is used. In the raster scan method, the deflection coil controls the amount of deflection of the electron beam so that the electron beam horizontally scans the screen (toward the front or back in FIG. 11) and scans vertically (in the direction of Y in FIG. 11), the horizontal and vertical scans forming a raster.

The internal magnetic shield 115 cannot shield the CRT completely from external magnetic fields. Therefore, in reality, the internal magnetic shield 115 (a) shields the CRT from external magnetic fields to some extent, (b) changes the direction of the magnetic force so as not to affect the election beam, or (c) corrects the force the electron beam receives at a certain position.

Except for some special cases, an external magnetic field that affects the electron beam is the terrestrial magnetism. The terrestrial magnetism is divided into a horizontal component (a horizontal component of a vector relative to the viewing angle of the screen) and a vertical component (a vertical component of a vector relative to the viewing angle of the screen). As is well known, the vertical component changes the landing uniformly over the whole screen. The landing deviation caused by the vertical component are not regarded as a problem since the phosphor screen position is corrected using a correction lens or the like when the phosphor screen is formed.

In contrast, a horizontal magnetic field changes its direction depending on the relative positions of the CRT and the magnetic field. Typically, as shown in FIG. 12, a horizontal magnetic field 120 is divided into a CRT tube-axis direction 121 and a lateral direction 122. Here, the space through which the electron beam passes is conical, expanding as the electron beam proceeds. The axis of the conical space through which the electron beam passes is called tube axis.

To achieve a shield from the terrestrial magnetism, it is necessary to consider the magnetic characteristics of a lateral magnetic field and a tube-axis-direction magnetic field which are components of a horizontal force of the terrestrial magnetism.

It is possible to apply from outside a magnetic field force equivalent to the terrestrial magnetism force or stronger, measure the electron beam landing deviation on the phosphor screen caused by the application of the force, and evaluate the magnetic characteristics in the CRT. FIG. 13 shows the measuring points: four corner points; and two center points (hereinafter referred to as NS points) of upper and lower portions. Here, important characteristics are as follows:

(1) characteristics at corner points (hereinafter called lateral characteristics) when a lateral magnetic field is applied; and (2) characteristics at NS points (hereinafter called NS characteristics) when a tube-axis-direction magnetic field is applied.

FIG. 14 shows the shape of a conventional internal magnetic shield 115. The internal magnetic shield 115 generally has a truncated, open pyramid shape including two long sides 141 opposite to each other and two short sides 142 opposite to each other, where an opening 143 formed at the top and an opening (not shown) formed at the bottom.

Recently, CRTs with a large-screen or a flat-screen are becoming mainstream. A conventional shadow mask used in a flat-screen CRT is typically manufactured by tightly spanning a plurality of wires between opposite sides of a frame.

In CRTs with such a conventional internal magnetic shield, the landing deviation caused by terrestrial magnetism tends to increase. This is because, with the conventional shadow mask, the magnetic reluctance of the shadow mask generates undesired magnetic field in the vicinity of the shadow mask (R. Murai et al., "Home Base Shaped Inner Magnetic Shield" SID2000DIGEST, pp 582–585). For example, in conventional 25-inch CRTs, both lateral characteristics and NS characteristics are approximately 10 $\mu$m. However, after the shadow mask is added, the lateral characteristics become 30 $\mu$m and NS characteristics become 25 $\mu$m. Typically, both characteristics deteriorate.

Up to now, there has been some attempts to improve the characteristics of the internal magnetic shield with the construction shown in FIG. 14. For example, the top of the short sides 142 of the internal magnetic shield is cut to form a V-shaped cut 144 as shown in FIG. 14, and optimization is performed by changing the depth or width of the cut 144.

The characteristics more greatly change when the depth of the V-shaped cut is changed, than when the width or the like is changed. FIG. 15 shows relation between the landing deviation and the depth of the V-shaped cut. As shown in FIG. 15, the deeper the cut is, the more improved the characteristics is. However, the NS characteristics rarely change. When the depth of the V-shaped cut is changed from 0 mm to 150 mm, the lateral characteristics change by 10 $\mu$m, but the NS characteristics rarely change.

By the optimization of the V-shaped cut, the landing deviation caused by an external magnetic field equivalent to the terrestrial magnetism has been improved as follows:

$$(\text{lateral characteristics, NS characteristics})=(20\ \mu\text{m},\ 23\ \mu\text{m})$$

However, improvement to both characteristics have not been achieved yet.

Also, the lateral characteristics and NS characteristics are in a tradeoff relationship in which the change rates of the characteristics are almost the same and the directions but reversed. This renders it more difficult to improve both the characteristics at the same time.

SUMMARY OF THE INVENTION

It is therefore an object of the present invention to provide a cathode ray tube that decreases the electron beam landing deviation caused by an external magnetic field such as from terrestrial magnetism and prevents the color on the screen from blurring or fading.

To fulfill the above object, the present invention is characterized by the magnetic field distribution inside the internal magnetic shield in the vicinity of the deflection coil and by the magnetic field distribution in the vicinity of the shadow mask.

To fulfill the above object, the magnetic field distribution on the trajectory of electron beams for displaying the circumferential portion of an image on the CRT screen is important. This portion corresponds to upper and lower areas each occupying approximately 20% of the area of a plane at the entrance of the internal magnetic shield.

It has been found that to improve the NS characteristics, the distribution of the vertical magnetic field (represented by "By". Here, the term "vertical" indicates a direction along the vertical scanning direction) should be modified. More specifically, as shown in FIG. 16, a prominent effect is produced when the By component in the vicinity of the deflection coil and the By component in the vicinity of the shadow mask are oriented in opposite directions (plus and minus directions). Note that in FIG. 16, the magnetic field By is represented by a relative value. With this construction, it is possible to deviate the trajectory of an electron beam at the entrance of the internal magnetic shield to a direction opposite to a direction of deviation of the trajectory generated in the vicinity of the mask, offsetting a force that is applied to the electron beam perpendicular to the electron beam trajectory, and decrease the landing deviation of the electron beam.

To orient the By component in the vicinity of the deflection coil to the minus direction, the inventors improved the internal magnetic shield as follows.

(1) The inventors devised the shape of the internal magnetic shield so that the amount of magnetic flux absorbed at both ends (in the embodiment, the long sides) in the vertical scanning direction at the entrance of the electron beam in the vicinity of the deflection coil is larger than that at both ends (in the embodiment, the short sides) in the horizontal scanning direction.

(2) The inventors changed the effective permeability so that the amount of magnetic flux absorbed at both ends in the vertical scanning direction at the entrance of the electron beam in the vicinity of the deflection coil is larger than that at both ends in the horizontal scanning direction.

The effective permeability can be changed, for example, by forming both ends in the vertical scanning direction at the entrance of the electron beam in the vicinity of the deflection coil using a material having substantially high effective permeability, and forming both ends in the horizontal scanning direction using a material having substantially low effective permeability.

As described above, the present invention decreases the electron beam landing deviation by changing the magnetic field distribution inside the internal magnetic shield in the vicinity of the deflection coil and the magnetic field distribution in the vicinity of the shadow mask.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Figure 1:
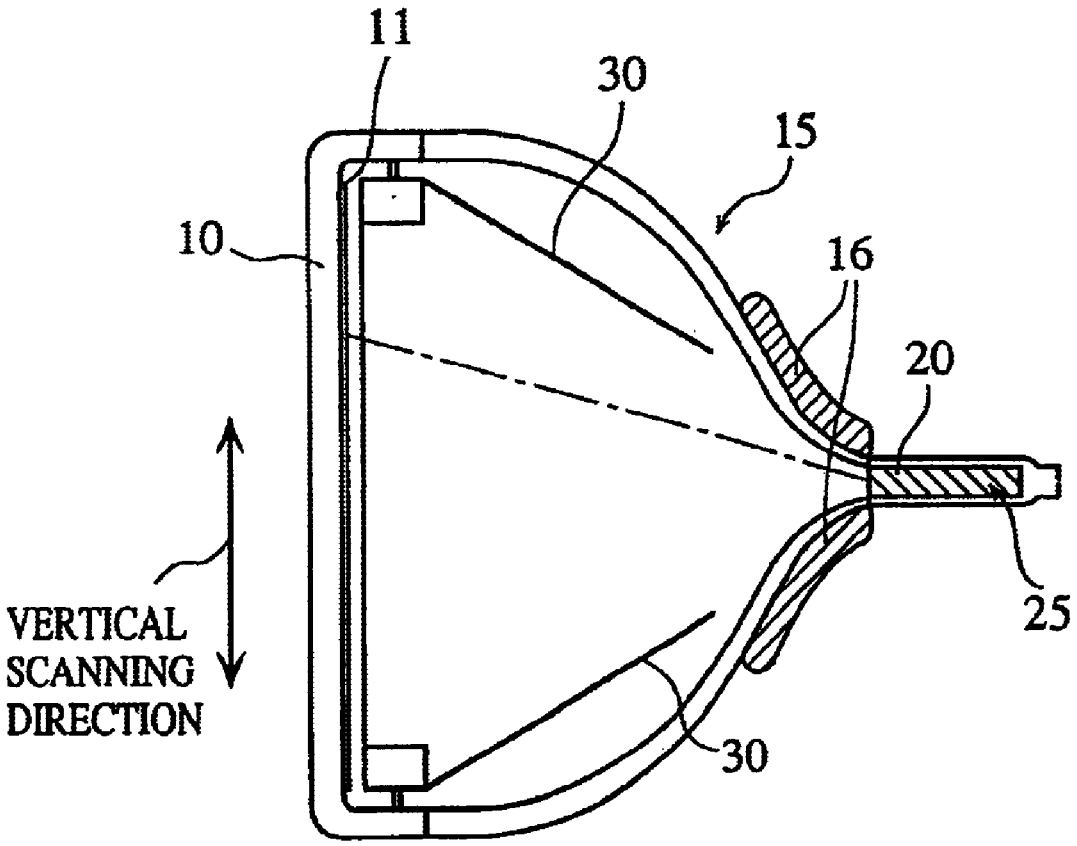
FIG. 1 is a sectional view of a CRT in the embodiment of the present invention.

The following are description of the present invention through specific embodiments thereof by way of referring to the drawings.

Embodiment

The CRT of the present invention will be described in detail.

Construction of CRT and Internal Magnetic Shield

FIG. 1 is a sectional view of the embodiment of the present invention.

The CRT shown in FIG. 1 is a 25-inch, flat-screen (front portion of the face plate is flat) CRT and the shadow mask is a wire-spanned-frame type.

More specifically, the CRT mainly includes: a face plate 10 whose front portion is flat; a funnel unit 15 including an internal magnetic shield 30; a neck unit 20; and an electron gun 25 inserted in the neck unit 20. It is understood that an electron gun is generally a source of an electron beam.

Phosphor units 11 for various colors are formed inside the front portion of the face plate 10. Also, a deflection coil 16 is attached to the CRT, surrounding an end of the funnel 15 opposite to the face plate 10.

Figure 2:
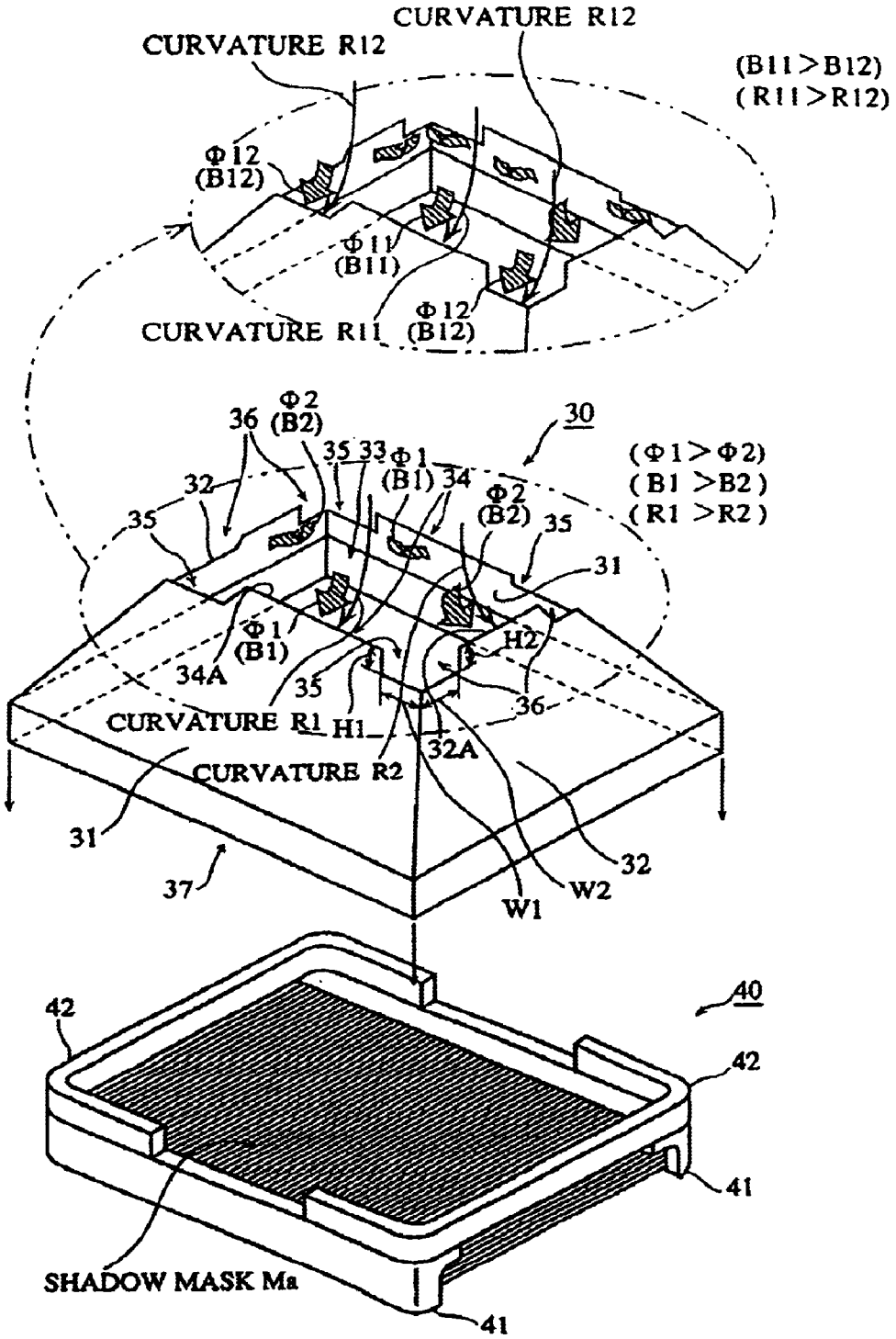
FIG. 2 shows the internal structure of the CRT focusing on a main portion related to the present invention, and is a perspective view of the internal magnetic shield 30 and a mask frame 40 which are to be assembled.

FIG. 2 shows the internal structure of the CRT focusing on a main portion related to the present invention, and is a perspective view of the internal magnetic shield 30 and a mask frame 40 assembled.

As shown in FIG. 2, the internal magnetic shield 30 is a pyramid-like shape, in the form of a hollow rectangular frustum, including two opposite long sides 31 and two opposite short sides 32, having an opening 33 at the top, or apex, and an opening 37 at the bottom.

A rectangular long side extension 34 is formed at a horizontal center of an upper end (in the vicinity of the deflection coil 16) of each long side 31. In reference to FIG. 2, the long side extension is a planar continuation of the long side 31 and that the long side extension 34 has lateral edges facing the nearest corners.

Cuts 35 are formed on both sides of the extension 34 at upper corners of each long side 31.

Cuts 36 are formed at upper corners of each short side 32, in align with the cuts 35.

It is defined that a height H1 of an upper end 34A of the long side extension 34 is measured from the bottom of the cut 35 is higher than a height H2 of an upper end of the short side extension 32A measured from the bottom of the cuts 36. In reference to FIG. 2, the short side extension 32A is a planar continuation of the short side 32 and that the short side extension 32A has lateral edges facing the nearest corners. Note that the bottoms of the cuts 35 and 36 have the same height. It is understood that the term "cut" is commonly descriptive of the shape of the regions on either side of the long side and short side extensions, and that these regions may be formed by any suitable manufacturing technique not limited to cutting.

The mask frame 40 is composed of a pair of spanning units 41 and a pair of U-shaped holding units 42. The pair of U-shaped holding units 42 are arranged opposite to each other. The pair of U-shaped holding units 42 are welded and fixed at two pairs of opposite ends of the pair of spanning units 41. A plurality of tensed wires are spanned between the pair of spanning units 41, the plurality of wires forming a shadow mask Ma. The plurality of wires are spanned at certain positions of the holding units 42 which are determined to hold the tension of the shadow mask Ma and to increase the strength of the frame in the direction of tension.

A lower end of the internal magnetic shield is fixed, by welding or the like, to a plane of the mask frame 40 which is parallel to a plane on which the shadow mask Ma is spanned.

Action and Effects of Internal Magnetic Shield

As described above, a rectangular long side extension is formed at a horizontal center of an upper end of each long side so as to be higher than the short sides. With this construction, the amount (ø1) of magnetic flux absorbed at both ends of the internal magnetic shield in the vicinity of the deflection coil in a vertical scanning direction is larger than the amount (ø2) of magnetic flux absorbed at both ends of the internal magnetic shield in a horizontal scanning direction (ø1>ø2). In other words, the magnetic flux density (B1 and B11) at both ends of the internal magnetic shield in the vicinity of the deflection coil in a vertical scanning direction is higher than the magnetic flux density (B2) at both ends of the internal magnetic shield in a horizontal scanning direction (B1>B2).

Also, in each long side, the amount of magnetic flux absorbed at the extension 34 is larger than that at the cuts 35. As a result, the density of magnetic flux B11 absorbed at the extension 34 is higher than the density of magnetic flux B12 absorbed in the vicinity of the cuts 35. In reference to FIG. 2, this is illustrated by B11>B12. That is to say, magnetic fields concentrate on the extension 34.

When the amount of absorbed magnetic flux and the magnetic flux density in the internal magnetic shield differ between the horizontal direction and the vertical direction as in the above case, the By component in the vicinity of the deflection coil and the By component in the vicinity of the shadow mask are oriented in opposite directions (plus and minus directions). With this construction, it is possible to deflect the trajectory of an electron beam in the vicinity of an entrance of the internal magnetic shield in an opposite direction to a direction in which the electron beam is to deviate in the vicinity of the mask. That is to say, a force an electron beam receives in the vertical direction is canceled out. As a result, the NS characteristics are effectively improved. That is to say, the landing deviation of electron beams are effectively improved in terms of the NS characteristics.

Also, since different amounts of absorbed magnetic flux are generated by setting the extension of the long sides higher than the short sides, the curvature (R1) of magnetic flux being absorbed at both ends of the internal magnetic shield in the vicinity of the deflection coil in a vertical scanning direction is higher than the curvature (R2) of magnetic flux being absorbed at both ends of the internal magnetic shield in a horizontal scanning direction (R1>R2).

Also, in each long side, the curvature of magnetic flux R11 being absorbed at the extension 34 is higher than the curvature of magnetic flux R12 being absorbed at the cuts 35. In reference to FIG. 2, this is illustrated by R11>R12. This indicates that magnetic fields concentrate on the extension 34.

The reason why the curvature of magnetic flux differs at different areas as described above is considered to be that when an external magnetic field proceeding straight along the tube axis is absorbed in the vicinity of the entrance of the internal magnetic shield, the amount of magnetic flux absorbed at both ends in the vertical scanning direction is larger than that at both ends in the horizontal scanning direction, i.e., magnetic flux is absorbed more efficiently at both ends in the vertical scanning direction.

Normally, the external magnetic field is absorbed in every area surrounding the electron beam passing area, in the vicinity of the entrance of the internal magnetic shield. In contrast, in the case of the present embodiment, since the extensions are formed on the long sides, the external magnetic field is absorbed more at the extensions, not uniformly in every area surrounding the electron beam passing area.

The difference in the amount of absorbing external magnetic fields (amount of absorbing magnetic flux) depends on the difference between the heights H1 and H2, and there is an optimum range of values for the difference in achieving the above action. It should be noted here that the height H1 should be limited so that the ends of the internal magnetic shield does not enter the space surrounded by the deflection coil. This is because this would interrupt the deflection control by the deflection coil.

Figure 3:
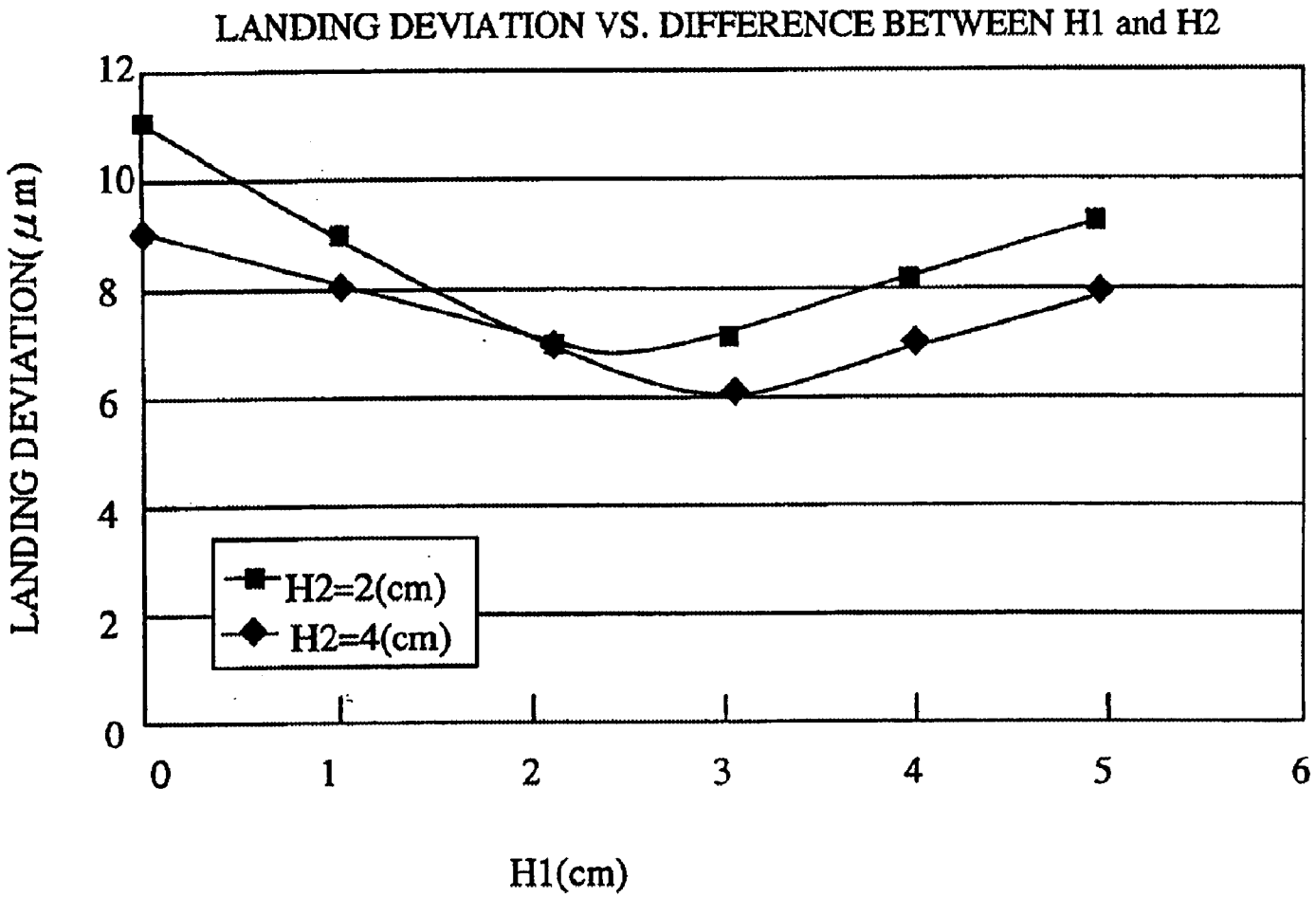
FIG. 3 shows measurement results of electron beam landing deviation in correspondence to varying heights H1 of the long side extension while the heights H2 of short side extension is fixed at 2 and 4 cm.

FIG. 3 shows measurement results of electron beam landing deviation in correspondence to the difference between the heights H1 and H2 (while H2 if fixed to 2 cm and 4 cm, H1 is varied. W1=W2=3 cm).

As shown in FIG. 3, regardless of whether H2 is 2 cm or 4 cm, the electron beam landing deviation shows a similar tendency. When H2 is 2 cm, H1=2–4 cm is the optimum range for which the landing deviation is smallest.

The difference in the amount of absorbing external magnetic fields (amount of absorbing magnetic flux) becomes more prominent by forming the cuts 35 and 36 at upper corners of the long and short sides 31 and 32. The reason for this is considered to be that by forming the cuts 35 and 36, the amount of magnetic flux absorbed at the areas where the cuts 35 and 36 are formed is reduced, and the magnetic flux is absorbed at the long side and short side extensions more efficiently. There is also an optimum range of values for the size of the cuts in achieving the above action.

Figure 4:
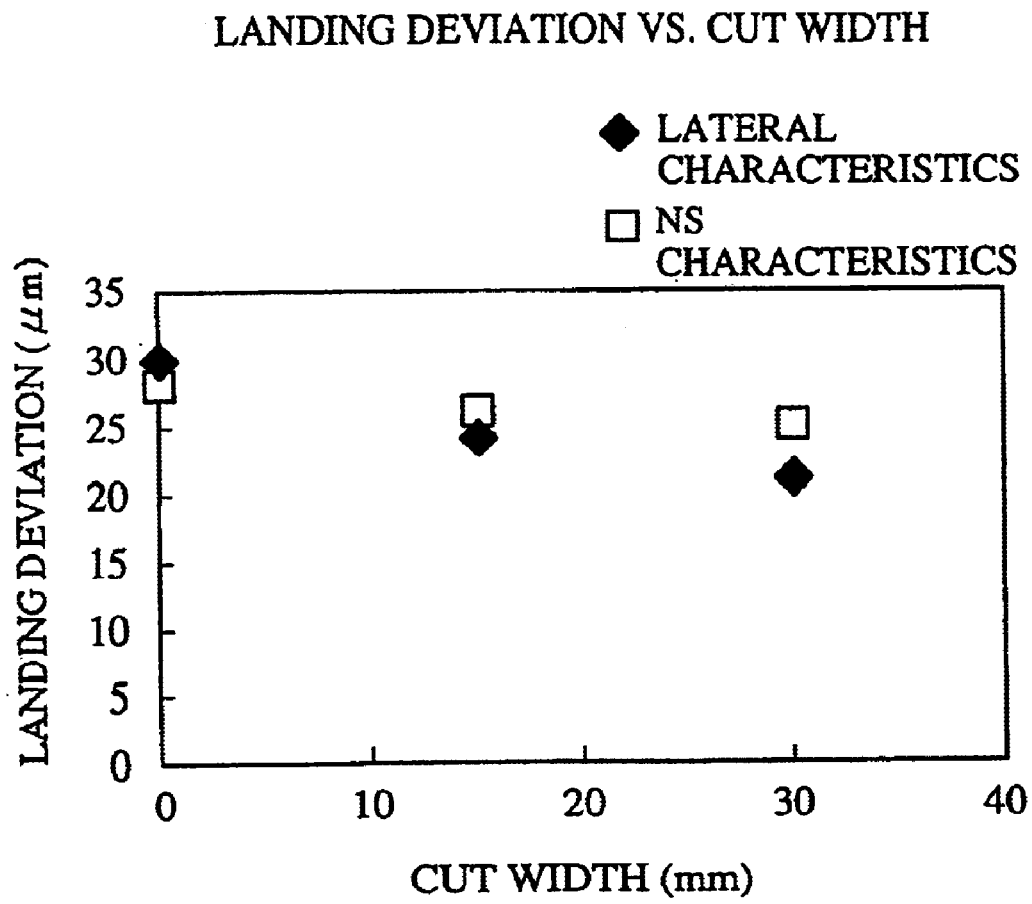
FIG. 4 shows relation between the width W1 of the cuts 35 and the electron beam landing deviation.

FIG. 4 shows measurement results of electron beam landing deviation in correspondence to the varied widths W1 and W2 of the cuts when the depth of the cuts 35 and 36 is 2 cm, where W1=W2.

Figure 15:
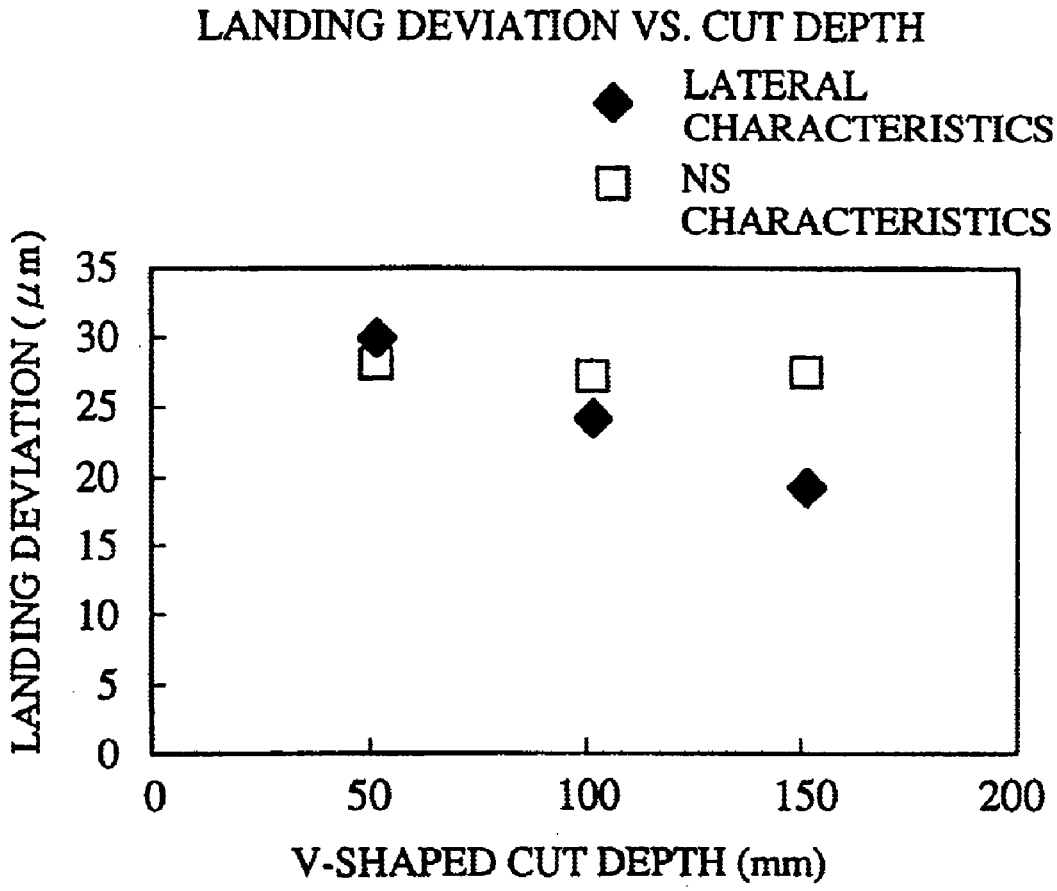
FIG. 15 shows relation between the electron beam landing deviation and the depth of the V-shaped cut of the internal magnetic shield for the conventional CRT.
Figure 16:
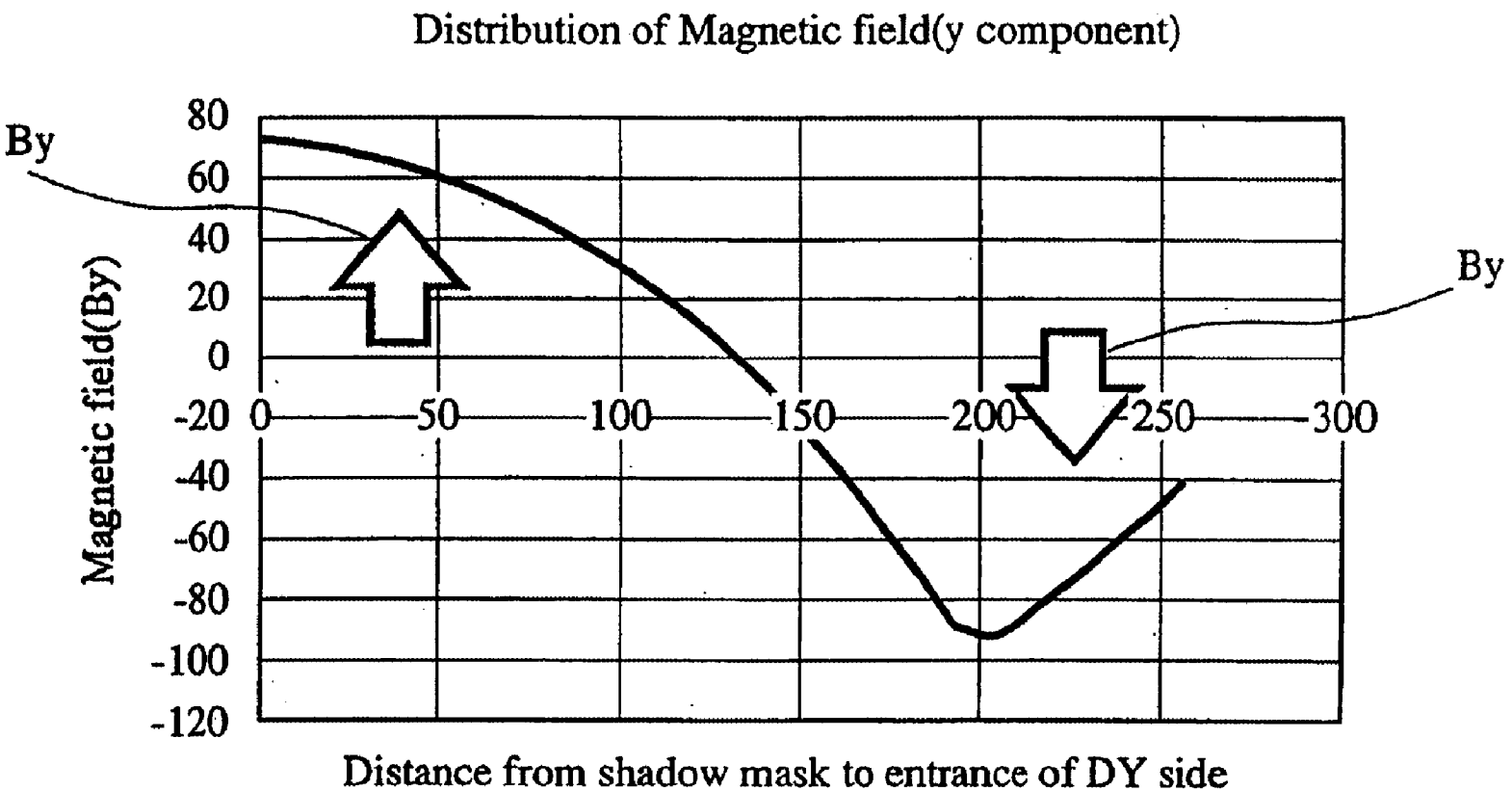
FIG. 16 shows the distribution of a magnetic field generated in the vertical direction in the CRT of the present invention.

Compared to the measurement results shown in FIG. 15 of electron beam landing deviation for the varied depth of the V-shaped cut formed in the short sides, it is understood from FIG. 4 that by forming the cuts at upper corners, the NS characteristics are improved, though the lateral characteristics are less improved. However, it is also found that both the V-shaped cut and the cuts at upper corners can be formed, as will be described later. It should be noted here that although the measurement results do not show, it is desirable that the width of a cut 35 at an upper corner of a long side is less than half of the length of the upper end of the long side.

As apparent from above, the present embodiment provides an excellent method for improving the NS characteristics when a type of tube is used for which the lateral characteristics do not matter much. Minute adjustments are made by varying the cut widths W1 and W2.

In the above description, it is presumed that the depth of the cuts is 2 cm. However, similar effects are obtained by changing the depth of the cuts.

Figure 5:
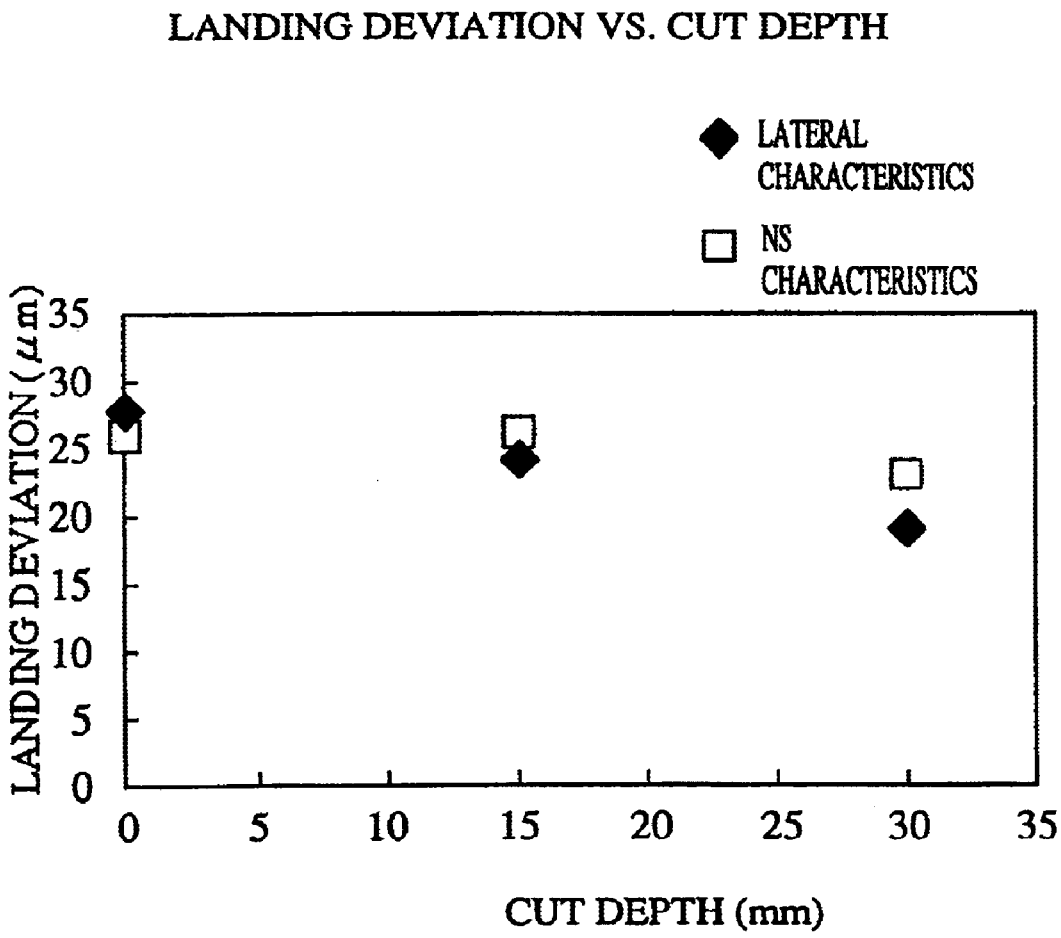
FIG. 5 shows relation between the depth of the cuts 35 and the electron beam landing deviation.

FIG. 5 shows measurement results of electron beam landing deviation in correspondence to the varied depths of the cuts when the width of the cut in the short side is 3 cm, and the width of the cut in the long side is 5 cm.

Using the above-described internal magnetic shield, it is possible to form a magnetic field that offsets an external force such as terrestrial magnetism an electron beam receives before it reaches the phosphor screen. This weakens the received force, decreases the landing deviation, and prevents the color on the screen from blurring or fading. It is also possible to offset effects of external magnetic fields typified by the terrestrial magnetism and improve the NS characteristics.

Variations (1) A V-shaped cut may be formed in each short side 32 at the opening 33 in the vicinity of the center of the deflection coil.

Figure 6A:
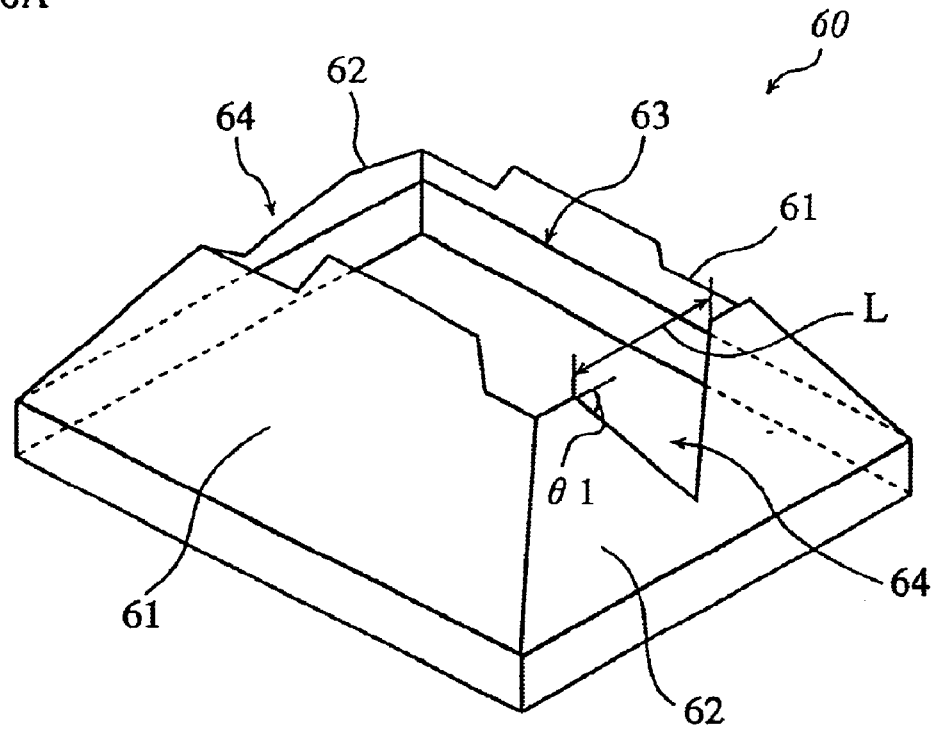
FIGS. 6A and 6B are perspective views showing the construction of the internal magnetic shield in variations of the embodiment.
Figure 6B:
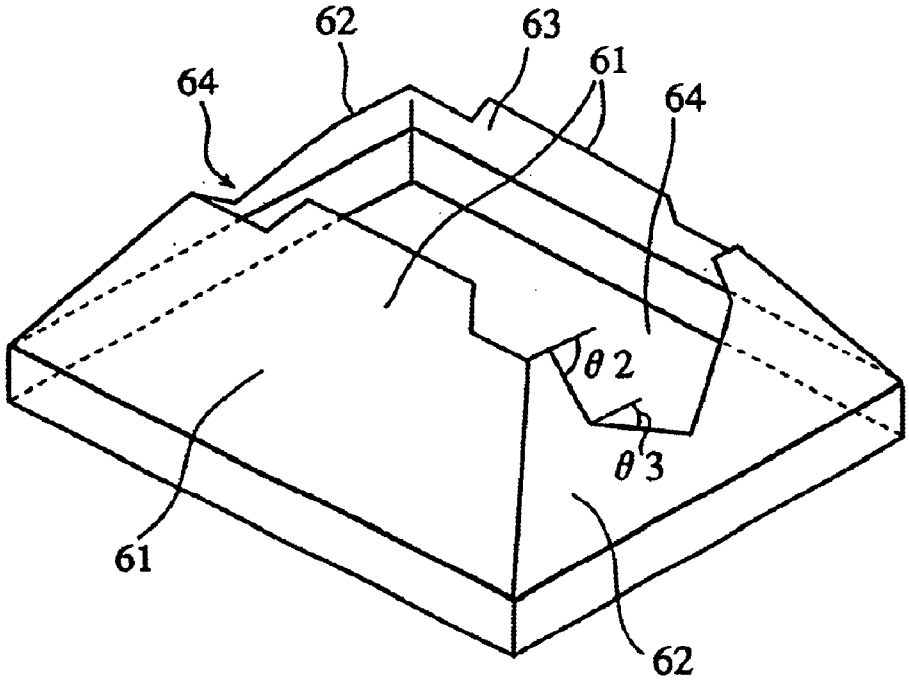

More specifically, V-shaped cuts as shown in FIGS. 6A and 6B are formed.

As shown in FIGS. 6A and 6B, the internal magnetic shield 60 is a pyramid including two opposite long sides 61 and two opposite short sides 62, where an opening 63 is formed in a direction along the axis of the pyramid, and a cut 64 is formed in each short side at the opening in the vicinity of the center of the deflection coil.

The cut 64 shown in FIG. 6A is a simple cut with one cut angle (θ1).

In contrast, the cut 64 shown in FIG. 6B has two cut angles: a wide cut angle θ2; and a narrow cut angle θ3, and is home-plate-shaped.

Figure 7A:
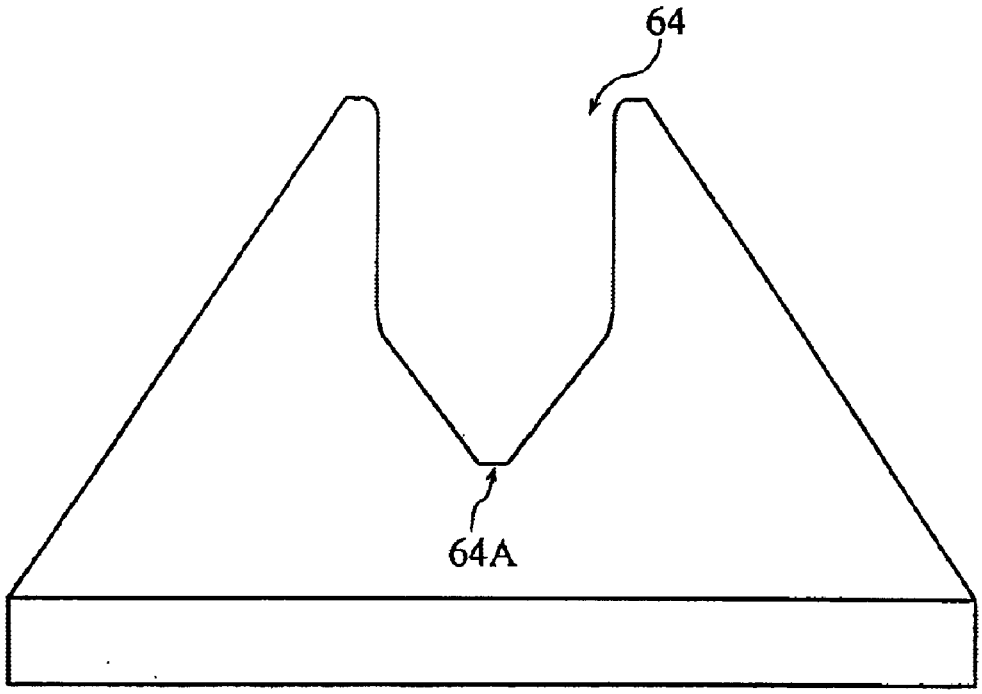
FIGS. 7A and 7B are plan views of a short side constituting the internal magnetic shield in variations of the embodiment.
Figure 7B:
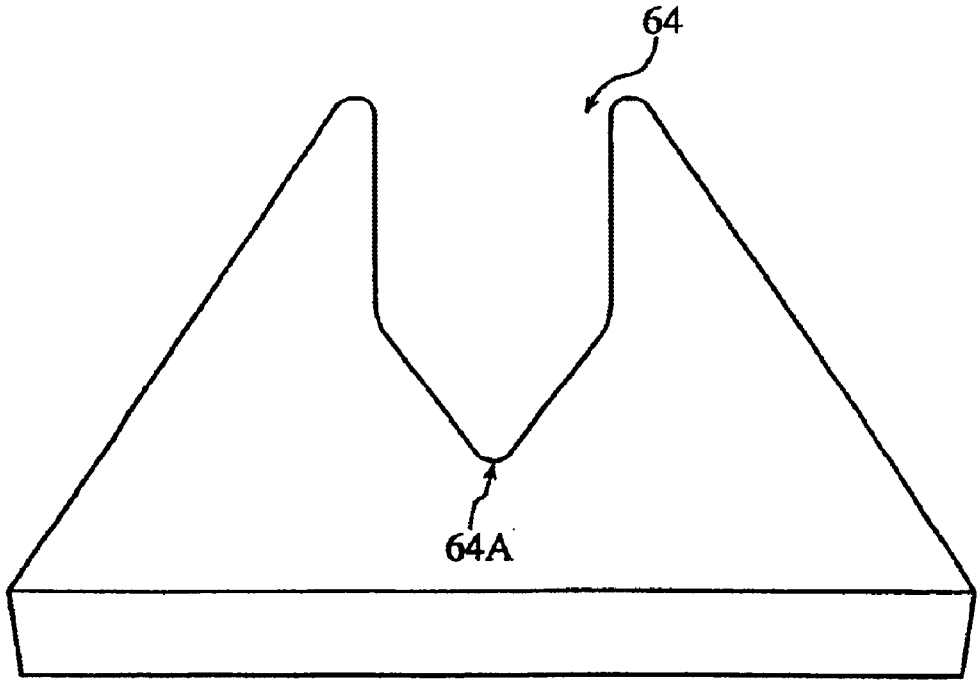

(2) The bottom 64A of the cut 64 may be flat having a certain width as shown in FIG. 7A, or may be semicircular as shown in FIG. 7B, instead of a narrow angle.

Figure 8:
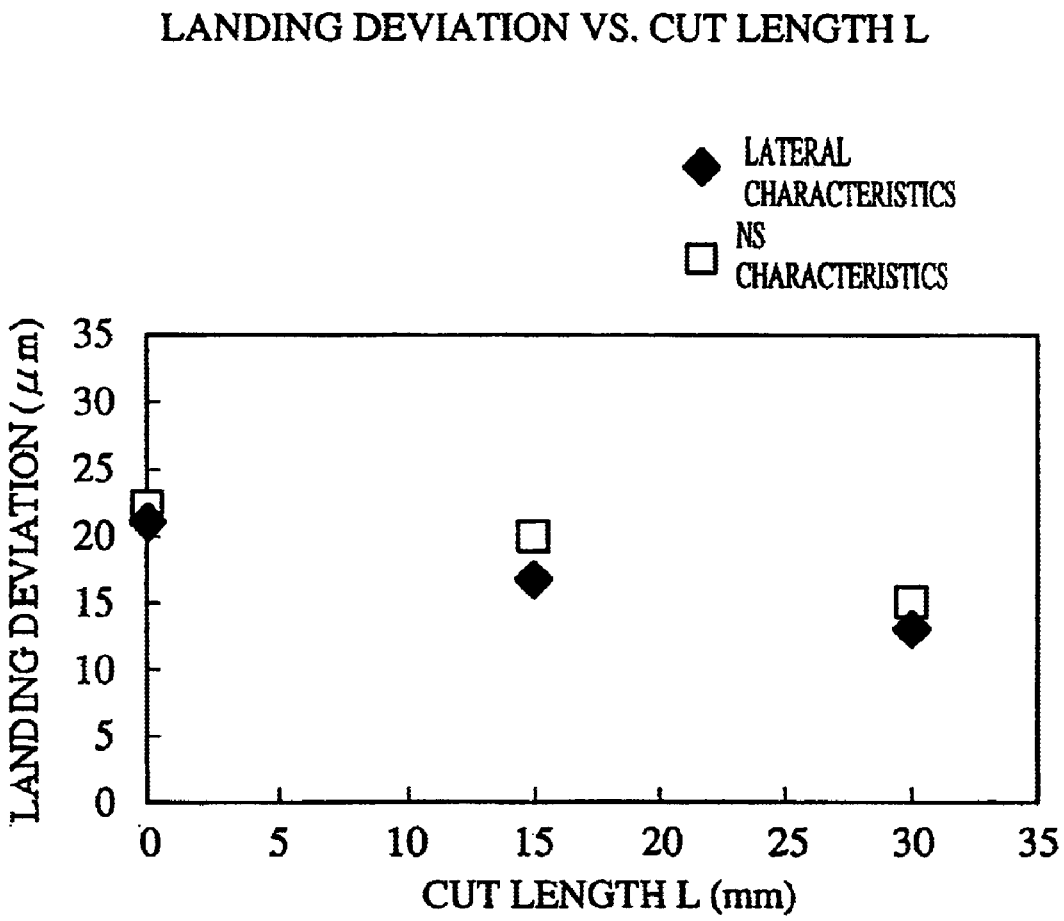
FIG. 8 shows relation between the length L of the cuts 54 and the electron beam landing deviation.

FIG. 8 shows measurement results of electron beam landing deviation in correspondence to the varied width (represented by L in FIG. 6A) of the cut 64. As shown in FIG. 8, the NS characteristics and the lateral characteristics similarly change.

Figure 9A:
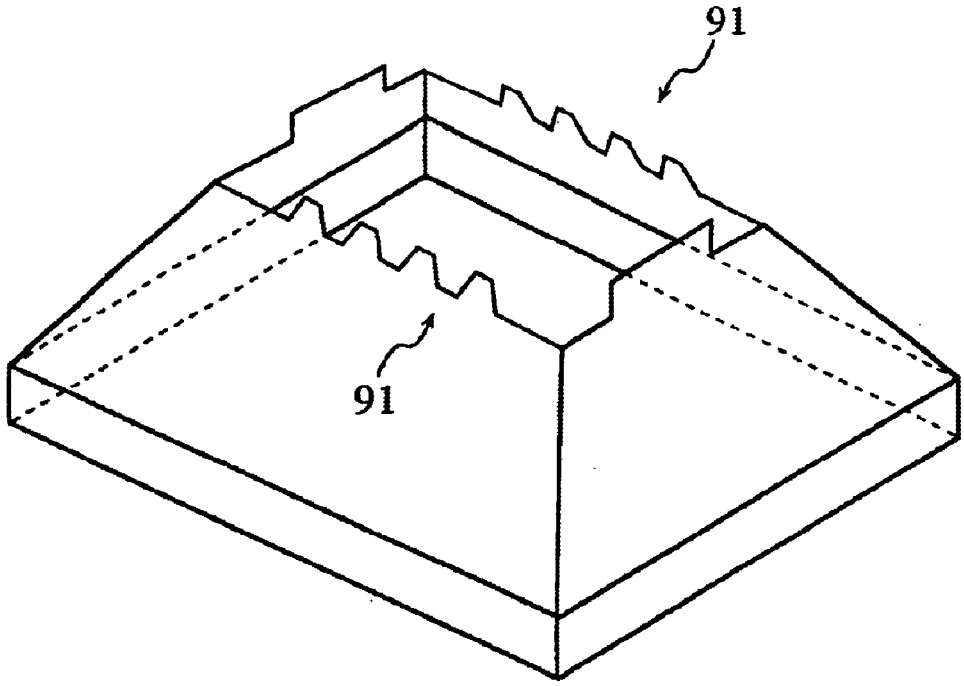
FIGS. 9A and 9B are perspective views showing the construction of the internal magnetic shield in variations of the embodiment.
Figure 9B:
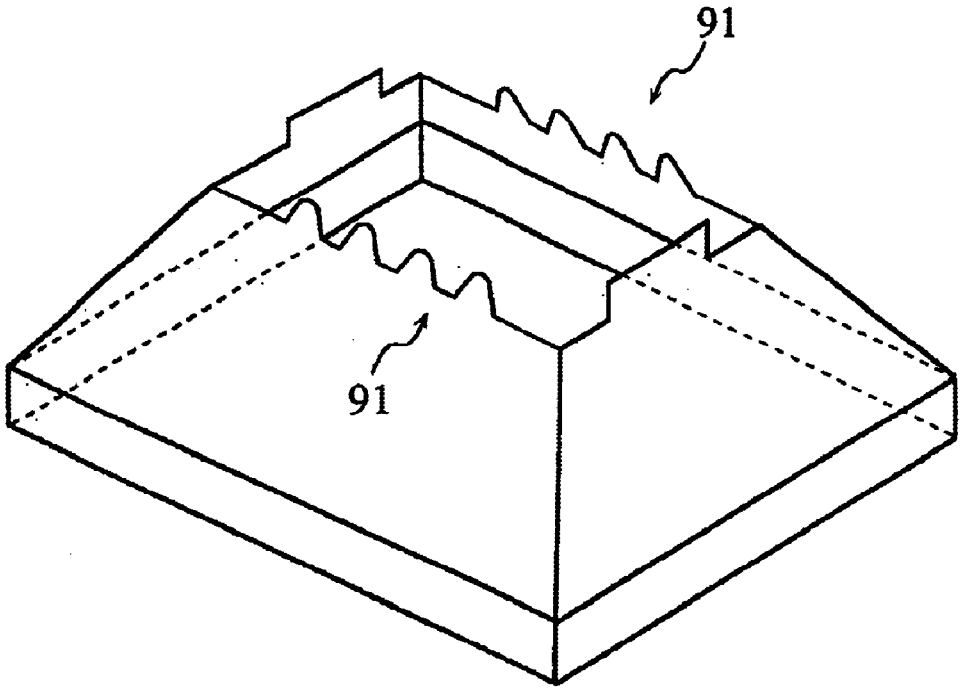

Accordingly, when L=30 mm,

NS characteristics=15 μm lateral characteristics=10 μm (3) The extension may be a plurality of projections 91 as shown in FIGS. 9A and 9B.

The projections may be rectangular as shown in FIG. 9A, or semicircular as shown in FIG. 9B.

Figure 10:
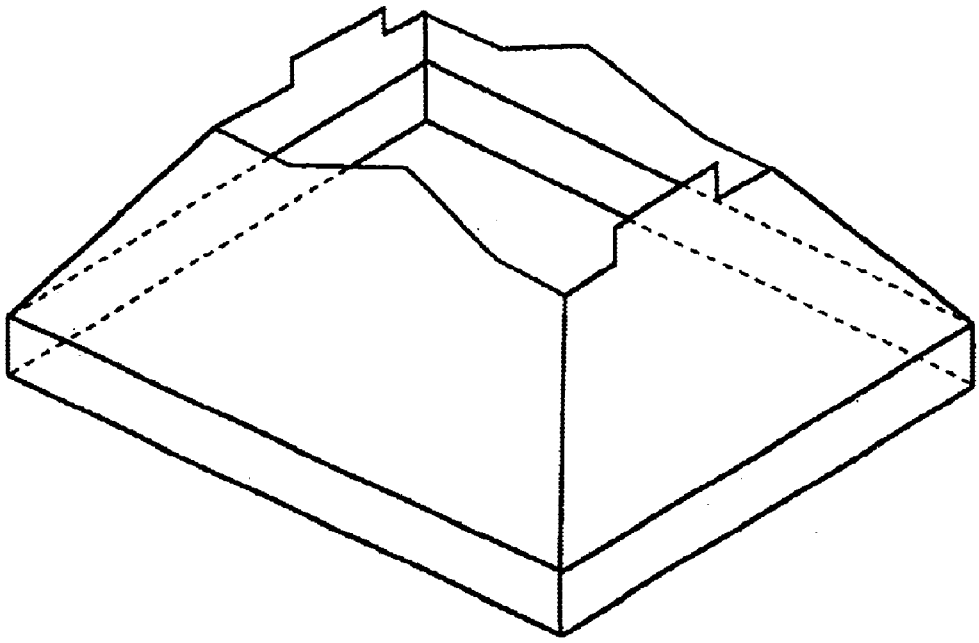
FIG. 10 is a perspective view showing the construction of the internal magnetic shield in a variation of the embodiment.
Figure 11:
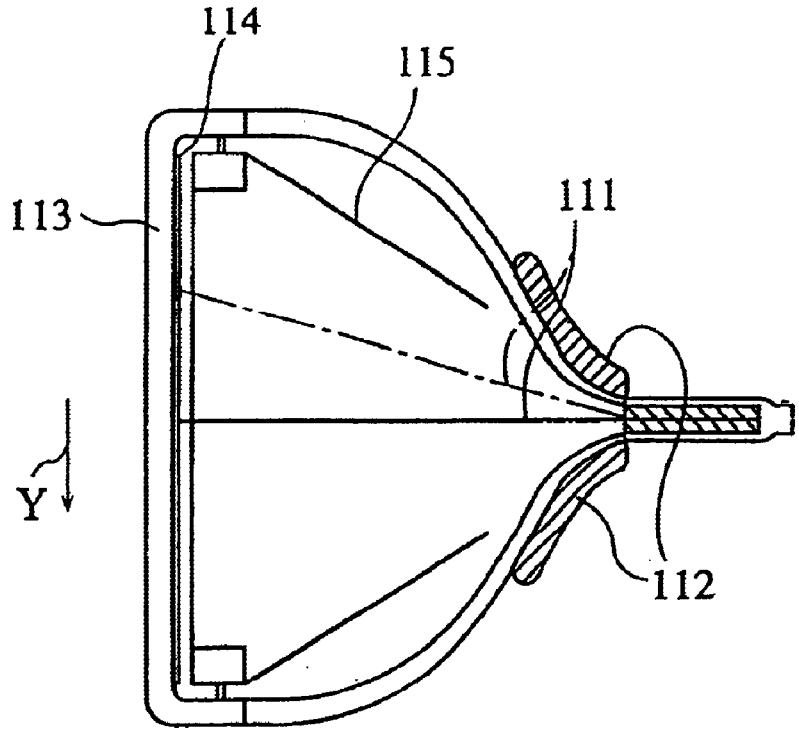
FIG. 11 PRIOR ART
FIG. 11 is a sectional view of a conventional CRT.
Figure 12:
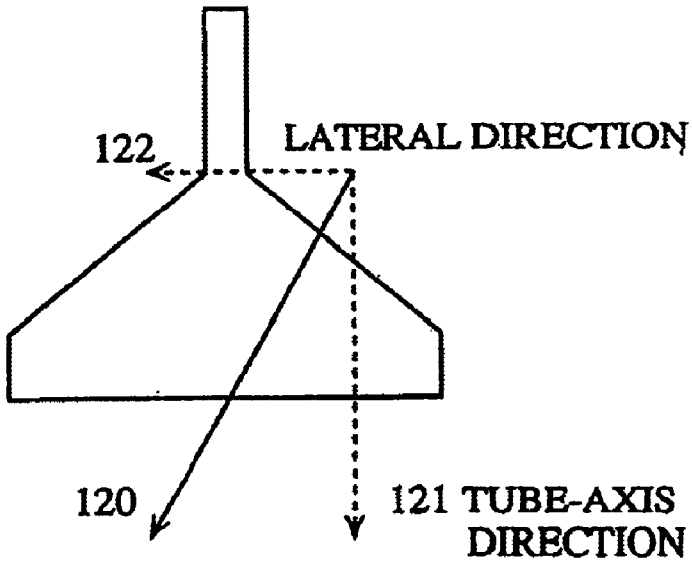
FIG. 12 PRIOR ART
FIG. 12 shows lateral and tube-axis components of an example magnetic vector applied to the CRT.
Figure 13:
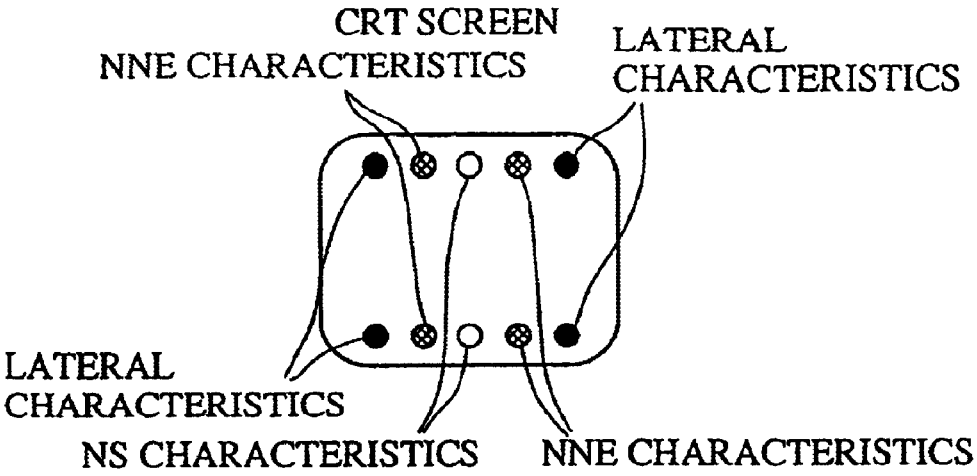
FIG. 13 PRIOR ART
FIG. 13 shows the conventional measuring points of the landing deviation on a CRT screen.
Figure 14:
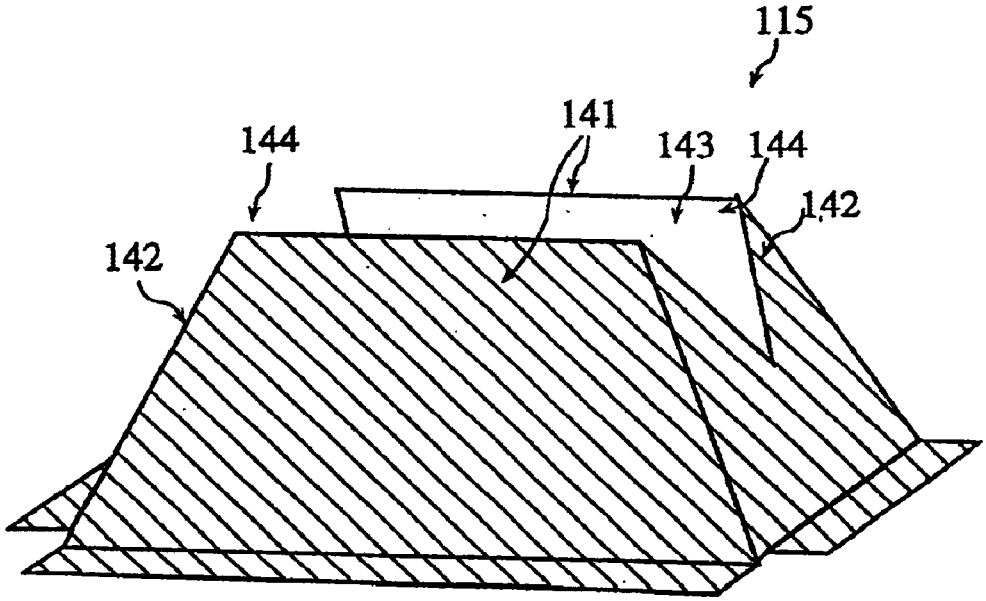
FIG. 14 PRIOR ART
FIG. 14 is a perspective view showing the construction of the internal magnetic shield for a conventional CRT.

The center of the extension may be triangular having a cute angle, as shown in FIG. 10. With this construction, the magnetic flux is absorbed more effectively at this portion.

It should be noted here that in the drawings from 1 to 10, the magnetic shield and mask frame are drawn separated for the sake of clarity.

It is presumed in the above embodiment that the present invention is achieved in a 25-inch CRT. However, the present invention is applicable to CRTs of other screen sizes. The height of the extension or the width of the cut change in accordance with the size of the CRT or the environment in which the CRT is used. The electron beam landing deviation may be caused by a magnetic field generated by the deflection coil, as well as by an external magnetic field. The trajectory of an electron beam also changes in accordance with the characteristics of the deflection coil, regardless of the shape of the internal magnetic shield. Accordingly, an optimum internal magnetic shield is formed by adjusting the size of each component based on the characteristics of the deflection coil.

The present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A cathode ray tube comprising:

a face plate having a phosphor screen on an inner main surface thereof;

an electron gun operable to emit an electron beam toward the phosphor screen;

a frame that holds a mask at a place between the electron gun and the inner main surface and closet to the inner main surface, so that the mask is substantially in parallel with the inner main surface; and an internal magnetic shield that is a pyramid having two openings respectively at an apex and a bottom of the pyramid, has two opposite long sides and two opposite short sides, and is deposited to surround a path of the electron beam with the apex of the pyramid being on a side of the electron gun, wherein an end of the internal magnetic shield being the bottom of the pyramid is attached, inside the cathode ray tube, to the frame, and two corners of each long side are cut to extend the opening on the side of the electron gun, wherein a length of each cut along an edge of each long side demarking the opening on the side of the electron gun is less than half of a length of the edge.

2. The cathode ray tube of claim 1, wherein two corners of each short side are cut to extend the opening on the side of the electron gun so that the cuts of the long sides and the short sides extend to each other at each corner.

3. The cathode ray tube of claim 2, wherein bottoms of the cuts of the long and short sides are continuous without a step.

4. The cathode ray tube of claim 2, wherein an equation "H1>H2" is satisfied, H1 representing a depth of the cuts of the long sides, and H2 representing a depth of the cuts of the short sides.

5. The cathode ray tube of claim 4, wherein the electron beam emitted from the electron gun is deflected vertically or horizontally by a deflection magnetic field and scans the phosphor screen, and in a magnetic flux which acts on an electron beam that passes through either an upper or lower area each occupying 20% of an electron beam passing area along a vertical scanning direction, an equation "B1>B2" is satisfied, B1 representing a magnetic flux density generated at the opening on the side of the electron gun in a direction from a tube axis toward the upper or lower area, and B2 representing a density of each magnetic flux generated at both ends of the electron beam passing area in a horizontal scanning direction passing the tube axis, and an equation "B11>B12" is satisfied, B11 representing a magnetic flux density generated at the opening on the side of the electron gun in a direction from the tube axis toward the center of the upper or lower area, and B12 representing a density of each magnetic flux generated at the opening on the side of the electron gun in a direction from the tube axis toward both cuts at both ends in a horizontal direction of the upper or lower area, wherein the tube axis is an axis of the electron beam passing area.

6. The cathode ray tube of claim 5, wherein an equation "R1>R2" is satisfied, R1 representing a curvature of a magnetic flux being absorbed by both ends of the internal magnetic shield in a vicinity of the opening on the side of the electron gun in a vertical scanning direction, and R2 representing a curvature of a magnetic flux being absorbed by both ends of the internal magnetic shield in the vicinity of the opening on the side of the electron gun in a horizontal scanning direction, and an equation "R11>R12" is satisfied, R11 representing a curvature of a magnetic flux being absorbed in a vicinity of the opening on the side of the electron gun in a vertical scanning direction at the center of the upper or lower area, and R12 representing a curvature of a magnetic flux being absorbed in a vicinity of the opening on the side of the electron gun at cuts at both ends in a horizontal direction of the upper or lower area, wherein the tube axis is an axis of the electron beam passing area.

7. The cathode ray tube of claim 1, wherein each long side has a rectangular extension at a center in a horizontal direction, by having two cuts at the opening on the side of the electron gun, and the extension is composed of a plurality of projections.

8. The cathode ray tube of claim 7, wherein each of the plurality of projections is rectangular or semi-circle-shaped.

9. The cathode ray tube of claim 1, wherein each short side is cut in a shape of a letter V, wherein a width, in a vertical direction, of the cut gradually decreases as the cut advances from an edge of each short side on the side of the electron gun toward the face plate.

10. The cathode ray tube of claim 9, wherein the cut of each short side widens upward and downward half way through a distance between the edge of each short side on the side of the electron gun and an end of the cut on a side of the face plate.

11. The cathode ray tube of claim 1, wherein the frame holds the mask by applying a tension to the mask.

12. In a magnetic shield for use within a cathode ray tube, the cathode ray tube having at least one source of an electron beam, wherein the magnetic shield is in the shape of a hollow rectangular frustum, the first and third sides of the hollow rectangular frustum being formed of two opposite long sides, the second and fourth sides of the hollow rectangular frustum being formed of two opposite short sides, the interface between each adjacent long side and short side forming corner joints that are continuous from the substantially wider base to the substantially narrower top of the hollow rectangular frustum, the magnetic shield being disposed to surround the path of the electron beam with the top of the hollow rectangular frustum positioned near the source of the electron beam, the electron beam defining an axis from the top to the base of the rectangular frustum, the improvement comprising:

each top edge of each long side of the hollow rectangular frustum has a long side extension of height H1 forming a planar continuation of each long side in the direction of the top of the hollow rectangular frustum, each long side extension being centered along the top edge of each long side, each long side extension having lateral edges separated from the nearest corner joint by a width W1 along the top edge of each long side, to enable the magnetic shield to reduce the deviation of an electron beam within the magnetic shield caused by any external magnetic field.

13. The magnetic shield of claim 12, wherein the width W1 is less than one-half the width of the entire top edge of each long side at the top of the hollow rectangular frustum.

14. The magnetic shield of claim 12, wherein each long side extension is substantially a rectangular shape.

15. The magnetic shield of claim 12, wherein each long side extension is substantially a trapezoidal shape.

16. The magnetic shield of claim 12, wherein each long side extension is substantially a triangular shape.

17. The magnetic shield of claim 12, wherein each long side extension is a plurality of projections.

18. The magnetic shield of claim 17, wherein the plurality of projections are rectangular.

19. The magnetic shield of claim 17, wherein the plurality of projections are semicircular.

20. The magnetic shield of claim 17, wherein the plurality of projections are trapezoidal.

21. The magnetic shield of claim 12, further comprising:

each top edge of each short side of the hollow rectangular frustum has a short side extension of height H2 forming a planar continuation of each short side in the direction of the top of the hollow rectangular frustum, each short side extension being centered along the top edge of each short side, each short side extension having lateral edges separated from the nearest corner joint by a width W2 along the top edge of each short side.

22. The magnetic shield of claim 21, wherein the width W2 is less than one-half the width of the entire top edge of each short side at the top of the hollow rectangular frustum.

23. The magnetic shield of claim 21, wherein the top edges of each adjacent long side and short side meet at the corner joints.

24. The magnetic shield of claim 21, wherein

H1 is greater than H2 so that the long side extension is higher than the short side extension.

25. The magnetic shield of claim 21, wherein each short side extension is substantially a rectangular shape.

26. The magnetic shield of claim 21, wherein each short side extension is substantially a trapezoidal shape.

27. The magnetic shield of claim 21, wherein the magnetic flux density generated at the long side extension is higher than the magnetic flux density generated at the short side extension.

28. The magnetic shield of claim 21, wherein the magnetic flux density generated at the long side extension is higher than the magnetic flux density generated between the long side extension lateral edges and the adjacent short side corner joints.

29. The magnetic shield of claim 21, wherein the magnetic flux density generated at the short side extension is higher than the magnetic flux density generated between the short side extension lateral edges and the adjacent long side corner joints.

30. The magnetic shield of claim 21, wherein each short side extension is a plurality of projections.

31. The magnetic shield of claim 30, wherein the plurality of projections are rectangular.

32. The magnetic shield of claim 30, wherein the plurality of projections are semicircular.

33. The magnetic shield of claim 30, wherein the plurality of projections are trapezoidal.

* * * * *

UNITED STATES PATENT AND TRADEMARK OFFICE

CERTIFICATE OF CORRECTION

PATENT NO. : 6,720,723 B2
APPLICATION NO. : 09/808818
DATED : April 13, 2004
INVENTOR(S) : Ryuichi Murai et al.

It is certified that error appears in the above-identified patent and that said Letters Patent is hereby corrected as shown below:

In the Claims:

Claim 1, Column 8, at line 46, please delete “closet” and insert --closer--.

Signed and Sealed this

Twenty-first Day of November, 2006

JON W. DUDAS
*Director of the United States Patent and Trademark Office*